US008783085B2

(12) United States Patent
Kuroiwa et al.

(10) Patent No.: US 8,783,085 B2
(45) Date of Patent: Jul. 22, 2014

(54) METHOD FOR STRAIGHTENING TUBE AND STRAIGHTENING ROLL

(75) Inventors: Yoshiyuki Kuroiwa, Arida (JP); Kouichi Kuroda, Takatsuki (JP); Tomio Yamakawa, Kawanishi (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/589,342

(22) Filed: Aug. 20, 2012

(65) Prior Publication Data

US 2012/0304724 A1 Dec. 6, 2012

Related U.S. Application Data

(63) Continuation of application No. PCT/JP2011/001719, filed on Mar. 24, 2011.

(30) Foreign Application Priority Data

Mar. 29, 2010 (JP) ..... 2010-075438

(51) Int. Cl.

| | |
|---|---|
| ***B21B 23/00*** | (2006.01) |
| *B21D 3/04* | (2006.01) |
| *B21D 3/05* | (2006.01) |
| *B21B 19/00* | (2006.01) |

(52) U.S. Cl.

USPC ..... 72/366.2; 72/99; 72/95; 72/235; 72/252.5

(58) Field of Classification Search

USPC ..... 72/31.03, 31.06, 95, 98, 99, 235, 226, 72/234, 366.2, 252.5; 492/1, 27

See application file for complete search history.

(56) References Cited

U.S. PATENT DOCUMENTS

| | | | | | |
|---|---|---|---|---|---|
| 1,649,204 | A * | 11/1927 | Wise | 492/1 |
| 2,655,194 | A * | 10/1953 | Nilsson | 72/98 |
| 3,047,046 | A * | 7/1962 | Nilsson | 72/99 |
| 3,858,425 | A * | 1/1975 | Thompson | 72/98 |
| 4,056,958 | A * | 11/1977 | Fangmeier et al. | 72/98 |
| 4,406,141 | A * | 9/1983 | Numano et al. | 72/98 |
| 4,494,394 | A * | 1/1985 | Nilsson | 72/98 |
| 4,565,083 | A * | 1/1986 | Thompson | 72/98 |
| 4,825,674 | A * | 5/1989 | Tanaka et al. | 72/98 |
| 7,654,122 | B2 * | 2/2010 | Tsuyuguchi et al. | 72/98 |
| 8,006,528 | B2 * | 8/2011 | Osako | 72/98 |
| 2005/0191509 | A1 * | 9/2005 | Nakashima et al. | 428/610 |
| 2009/0064752 | A1 * | 3/2009 | Tsuyuguchi et al. | 72/369 |

FOREIGN PATENT DOCUMENTS

| | | | |
|---|---|---|---|
| CN | 2248103 | | 2/1997 |
| EP | 182003 | A2 * | 5/1986 |
| JP | 59-229231 | | 12/1984 |
| JP | 61-123419 | | 6/1986 |
| JP | 02-207921 | | 8/1990 |
| JP | 04-072619 | | 11/1992 |

* cited by examiner

*Primary Examiner* — Shelley Self
*Assistant Examiner* — Pradeep C Battula
(74) *Attorney, Agent, or Firm* — Clark & Brody

(57) ABSTRACT

A method for straightening a tube by using an asymmetric roll, which has different diameters D1 (exit side), D2 (entry side) at relative maximum diameter portions, left and right roll shoulder portions, as a straightening roll of a straightener, wherein the roll shoulder having a smaller diameter is disposed to be located on the tube entry side. The straightening roll used therefor comprises roll shoulders 3*a* and 3*b* and a roll barrel portion 4, in which D1>D2 and 0.004≤(D1−D2)/d≤0.2 (d: outer diameter of tube to be straightened) are satisfied. Further, an aspect of the invention may define radii of curvatures of entry-side and exit-side shoulder potions in a section of the roll cut along a plane including the roll central axis, or a curve representing an outer surface of the roll barrel portion.

3 Claims, 8 Drawing Sheets

D1 = D2

D1 > D2

D1 > D2

D1 > D2

METHOD FOR STRAIGHTENING TUBE AND STRAIGHTENING ROLL

TECHNICAL FIELD

The present invention relates to a method for straightening a tube to correct bends of a tube such as a steel tube along its axial direction and out-of-roundness in its cross section (hereafter, referred to as an "oval shape"). In particular, the present invention relates to a method for straightening a tube, in which the deformation of a tube leading end portion (so-called "leading-end deformation"), which occurs in ordinary straightening method of the tube, can be suppressed to prevent a decline in yield which results from cutting off relevant leading-end deformation portions and can achieve sufficient straightening of the tube; and a straightening roll which can suppress the deformation of a tube leading end portion.

Unless otherwise stated, the definitions of terms in the present invention are as follows.

"Leading-end deformation" refers to a collapse of a tube end portion which is caused by the collision of the leading end of a tube to be straightened against the roll during the straightening of bends.

"Asymmetric roll" refers to a roll in which the heights of the left and right roll shoulder portions are different (to be precise, roll diameters at maximum diameter portions of the left and right roll shoulder portions are different) when the roll is disposed such that the roll axis is horizontal (in a direction normal to the gravity of the Earth) and is observed from a direction normal to the axis. In contrast, an ordinary straightening roll in which the roll diameters of the left and right roll shoulder portions are the same is also referred to as a "symmetric roll".

"Tube entry side" refers to a side from which a tube to be straightened is fed into in a straightening roll which is disposed with an inclination to a base pass line (the horizontal axis of center between upper roll center and lower roll center in a state where both an offset amount and a crush amount are zero). "Tube exit side" refers to a side from which the tube to be straightened exits from the straightening roll.

BACKGROUND ART

A tube produced by various tube making methods is subjected to a finishing process, thereafter being applied with treatments such as heat treatment as needed, and becomes an end product after undergoing an inspection and testing process. The straightening of tube is one of the processing which is conducted in the finishing process, and has its object to correct bends in a tube along its axial direction and oval shapes of the cross section of the tube, which result from the straightening of the bends.

For straightening a tube, generally, a press type machine or an inclined roll type straightening machine (a rotary straightener: hereafter, simply referred to as a "straightener") in which a plurality of concave type rolls are combined is used. There are a large number of configurations for a straightener resulting from the combinations of the number, and the arrangement and disposition of rolls. The description of the press machine is omitted since it is well known.

FIG. 1 is a diagram showing an example of the roll arrangement of a straightener. The straightener shown includes three pairs of straightening rolls: Ra1 and Rb1 (No. 1 stand), Ra2 and Rb2 (No. 2 stand), and Ra3 and Rb3 (No. 3 stand), each paired rolls being oppositely disposed with the directions of their rotational axes crossing with each other, and an auxiliary roll Rc (No. 4 stand (final stand)). The auxiliary roll Rc is a roll for enhancing the straightening effect by adjusting it vertically. These are also collectively called as straightening rolls. The straightener having the roll arrangement illustrated as an example in FIG. 1 is a 2-2-2-1 type straightener.

FIG. 2 is a diagram to explain the shape of a straightening roll to be used in a straightener, showing a roll longitudinal section (only an upper half above the roll axis) taken along any plane passing the roll axis. As shown in FIG. 2, the straightening roll has a so-called concave shape, and comprises roll shoulder portions, which stand at opposite ends, and a roll barrel portion having a concave surface which is curved from opposite roll shoulder portion toward the axial centerline of the roll starting from both the roll shoulder portions and to the middle of the roll (groove bottom P). The roll diameters D1 and D2 at major size roll shoulder portions are equal, and the curved surfaces forming the roll shoulder portions and the curved surfaces forming the barrel portion are symmetrical with respect to the length-wise middle of the roll (groove bottom P). That is, a conventional straightening roll has a symmetric shape.

In above described FIG. 1, it is possible to adjust the angle of the straightening roll R with respect to a base pass line (a roll angle which is required to make a workpiece move spirally) and a distance between opposite rolls (crush amount) of the paired straightening rolls R, respectively. Further, it is also possible to adjust, for example, the heights of central axes for the straightening rolls Ra2 and Rb2 of No. 2 stand in a vertical direction as an offset amount, with respect to the central axis for the straightening rolls Ra1 and Rb1 of No. 1 stand.

Generally, when straightening a tube by a straightener, the angle of each straightening roll R with respect to the tube 1 to be straightened (that is, a roll angle) is adjusted such that the surface of the tube 1 to be straightened lies along the surface of the straightening roll R. Further, the distance between respective straightening rolls R making up a pair at each stand is set to be slightly smaller than the outer diameter of the tube 1 to be straightened, thereby imposing pressure (crushing) on the tube, and the central axes of the straightening rolls Ra2 and Rb2 are made to be higher than (offset from) the central axes of the straightening rolls Ra1 and Rb1, and the straightening rolls Ra3 and Rb3, thereby giving a bending stress to the tube, to correct bends. That is, when straightening a tube by a straightener, it is necessary to appropriately adjust the roll angle, the crush amount, and the offset amount, which are setup conditions.

FIG. 3 is a diagram to explain the roll angle among the setup conditions for roll straightening. As shown in the figure, an angle θ formed between the axial centerline of a tube to be straightened and the central axis of the straightening roll R is the roll angle (degree). In the illustrated example, the straightening roll R is disposed below the tube 1 to be straightened, and the tube 1 moves to the direction shown by an outlined arrow by the rotation (rotation in the direction shown by the arrow) of the straightening roll R.

FIG. 4 is a diagram to explain the crush amount among the setup conditions for roll straightening. As shown in FIG. 4, the tube 1*b* to be straightened, which is applied with crush by roll straightening, is pressed to be deformed into an oval shape. In FIG. 4, a tube to be straightened (shown by a dashed line) before being applied with crush is denoted by a reference character 1*a*, and a tube to be straightened after being applied with crush is denoted by a reference character 1*b*. A crush amount c (mm) is shown by a difference between an original outer diameter d of the tube 1*a* to be straightened, before deformation, and a distance between paired straightening rolls Ra and Rb, and corresponds to the roll draft applied to the outer diameter of the tube 1 to be straightened. The tube 1 to be straightened is subjected to straightening of bends by being repeatedly pressed over its overall length while being rotated by the straightening rolls R.

FIG. 5 is a diagram to explain the offset amount among the setup conditions for roll straightening. As shown in the figure, the central axes of straightening rolls Ra2 and Rb2 are set (offset) to be higher than the central axes of straightening rolls Ra1, Rb1 in a first stand (on the near side (entry side) relative to the moving direction of the tube to be straightened). The offset amount δ (mm) is indicated by a displacement amount of the central axes of the straightening rolls Ra2 and Rb2 in a height direction (the direction of pressing). Further, the central axes of the straightening rolls Ra3 and Rb3 are at a lower level (which may not be the same level of the central axes of the straightening rolls Ra1 and Rb1) than that of the central axes of the straightening rolls Ra2 and Rb2 in a second stand, and are in a state of being inversely offset with respect to the straightening rolls Ra2 and Rb2. That is, straightening of bends is performed by alternately applying an upward and downward bending stress to the tube 1 to be straightened.

As described above, when performing straightening by a straightener, it becomes necessary to apply a certain level of load such as crushing and offsetting to the tube to be straightened. Therefore, studies on the method of setting an offset amount, a crush amount, and the like have been conducted up to now.

For example, Patent Literature 1 describes a method for setting an offset amount, a crush amount, and the like, in which an offset amount of the roll is determined based on a predetermined relationship between an index indicating a plastic deformation that is caused by offsetting in a tube section at an offset position, and the offset amount; and a crush amount of the roll is determined based on the predetermined relationship between an index indicating a plastic deformation that is caused by crushing in a tube section at a crush position, and the crush amount.

Meanwhile, if straightening processing is performed by setting an offset amount based on Patent Literature 1, there may be a case where a leading-end deformation (the front end portion of the tube to be processed) occurs. This is caused by that, when a tube is obliged to pass through the straightening rolls which are offset, the front end of the tube is liable to miss the engagement in between the upper and lower rolls, and collides with the rolls, thereby being subjected to an impact. The leading-end deformation occurs particularly when the offset amount is set to be larger (larger offsetting). Since occurrence of leading-end deformation causes the outer diameter to decrease, the affected part must be cut off thereby deteriorating the productivity.

Patent Literature 2 describes a method in which as a countermeasure for preventing the leading-end deformation, that is, a countermeasure for avoiding the collision of the front end of the tube to be processed against the roll, the distance of opposite rolls (the distance between the upper and lower rolls) of the roll pair (opposite rolls) which are oppositely disposed in a vertical direction is widely opened in advance, and if the front end of a tube enter between the opposite rolls, the upper roll which has been retracted upwardly is lowered to apply crushing (pressing rolling is started).

However, in such a method, since the front end of the tube will pass through the straightening roll before crushing is applied, straightening of the tube end portion will not be achieved. Further, it requires complex and highly accurate control. On the other hand, although there is a method in which the straightening condition is mitigated such as by setting a smaller offsetting, as well as a method in which the impact between the roll and the tube to be straightened is suppressed by enlarging the roll angle, the straightening force becomes weak in these methods, and thereby the straightening effect declines so that bends in the tube may not be sufficiently removed causing some of them to remain. If such bends remain, a separate re-straightening processing such as one to remove bends by using a press machine arranged in an off-line, or one to remove bends by passing the tube through the straightener again becomes necessary, thus deteriorating the productivity.

CITATION LIST

Patent Literature

Patent Literature 1: Japanese Patent Publication No. 4-72619

Patent Literature 2: Japanese Patent Application Publication No. 61-123419

SUMMARY OF INVENTION

Technical Problem

As described above, when straightening a tube such as a steel tube, particularly when a larger offsetting is applied to enhance the straightening effect, there may be a case where a leading-end deformation occurs. It is difficult to cope with this problem by means of the prior art.

The present invention has been made in view of such a problem regarding the straightening of tubes, and has its object to provide a method for straightening a tube, which can suppress a leading-end deformation which occurs during the straightening of the tube by use of an ordinary straightener, and can enhance the straightening effect by applying a larger offset amount to the tube to be straightened; and a straightening roll which can suppress the leading-end deformation.

Solution to Problem

The summaries of the present invention are as follows.

(1) A method for straightening a tube by using a straightener in which three or more pairs of rolls, each pair comprising two concave type rolls oppositely disposed in a vertical direction, are back-to-back disposed along a traveling direction of a tube to be straightened, wherein an asymmetric roll in which a diameter at a left roll shoulder as being a relative maximum diameter portion is different from that at a right roll shoulder as being another relative maximum diameter portion is used for at least one of upper and lower rolls constituting at least one pair of rolls, except for the pair of rolls located at foremost entry side with respect to the traveling direction of the tube to be straightened among a plural pairs of rolls, and wherein the roll shoulder as being a relative maximum diameter portion having a smaller diameter is located on a tube entry side and the roll shoulder as being a relative maximum diameter portion having a larger diameter is located on a tube exit side.

(2) A method for straightening a tube by using a straightener in which plural pairs of rolls, each pair comprising two concave type rolls oppositely disposed in a vertical direction, are disposed with a single roll interposed between the plural pairs of rolls and located at either of upper and lower positions, wherein an asymmetric roll in which a diameter at a left roll shoulder as being a relative maximum diameter portion is different from that at a right roll shoulder as being a relative maximum diameter portion, is used for at least one of upper and lower rolls constituting at least one pair of rolls, except for the pair of rolls located at foremost entry side with respect to the traveling direction of the tube to be straightened among the plural pairs of rolls, and/or for a single roll interposed between the plural pairs of rolls and located at either of upper and lower positions, and wherein the roll shoulder as being a relative maximum diameter portion having a smaller diameter is located on a tube entry side and the roll shoulder as being a relative maximum diameter portion having a larger diameter is located on a tube exit side.

In the above described (1) and (2), that the diameter at one roll shoulder of the asymmetric roll is larger or smaller compared to that at the other roll shoulder refers to a diameter of the relevant roll shoulder when the roll is disposed such that the roll axis is horizontal, and is observed from a direction normal to said axis.

(3) The method for straightening a tube according to above described (1), wherein used is a 2-2-2-1 type straightener in which three pairs of rolls are back-to-back disposed from the entry side along the traveling direction of the tube to be straightened, and a single roll is disposed thereafter at either of upper and lower positions, and wherein asymmetric rolls are used for both the upper and lower rolls constituting pairs of rolls at a second and third locations from the entry side.

(4) A straightening roll used for offsetting, among straightening rolls which are used in an inclined-roll-type tube straightening machine including concave type straightening rolls oppositely disposed in a vertical direction with axes of rotation thereof being crossed with each other, wherein the straightening roll comprises opposite roll shoulders as being relative maximum portions formed at end portions, and a roll barrel portion which lies between the roll shoulders as being relative maximum diameter portions and serves to press down a tube to be straightened, and wherein, given that D1 is a maximum diameter of the roll shoulder located at an exit side of the tube to be straightened, D2 is a diameter of the roll shoulder on an entry side, and d is an outer diameter of the tube to be straightened, the following Formulae (i) and (ii) are satisfied:

$$D1>D2 \quad \text{(i)}$$

$$0.004\leq(D1-D2)/d\leq0.2 \quad \text{(ii)}$$

(5) The straightening roll according to above described (4), wherein a curve representing an outer surface of a roll shoulder as being a relative maximum diameter portion in a longitudinal section of the straightening roll cut along a plane including the central axis of roll is disposed in a circular arc shape, and when, given that CR2 is a radius of curvature of an entry-side roll shoulder in the relevant section, and CR1 is a radius of curvature of an exit-side roll shoulder, the following Formula (iii) is satisfied:

$$CR2/CR1>1.0 \quad \text{(iii)}$$

(6) The straightening roll according to above described (4) or (5), wherein a curvature representing an outer surface of a roll barrel portion comprises a plurality of circular arcs or approximated circular arcs in a longitudinal section of the straightening roll cut along a plane including the central axis of roll, and wherein, given that R1 is a radius of curvature of a circular arc C1 constituting the outer surface of roll of a bottom portion of roll groove, among the plurality of circular arcs or approximated circular arcs, $R2_i$ is a radius of curvature for one or more circular arcs or approximated circular arcs formed on an entry side with respect to the circular arc C1, AL is a distance between a cross section at bottom portion of roll groove and an entry-side terminal end of the circular arc C1, and d is an outer diameter of the tube to be straightened, the following Formulae (iv) and (v) are satisfied:

$$R2_i/R1>1.0 \quad \text{(iv)}$$

$$0\leq AL/d\leq1.5 \quad \text{(v)}$$

Where, the cross section at the groove bottom portion of roll refers to a cross section which passes through a groove bottom position of roll at which the roll diameter becomes minimum and is perpendicular to the roll central axis. Moreover, the subscript "i" for $R2_i$ indicates the number of circular arcs or approximated circular arcs.

Advantageous Effects of Invention

The method for straightening a tube according to the present invention is a straightening method using an asymmetric roll in which the diameter of the left roll shoulder as being a relative maximum portion is different from that at the right shoulder as being the other relative maximum diameter portion. According to the method for straightening a tube of the present invention, since it becomes possible to suppress the occurrence of leading-end deformation, and also apply a larger offsetting to a tube to be straightened, enhanced straightening effects can be achieved.

The straightening roll of the present invention is an asymmetric roll comprising roll shoulders as being relative maximum diameter portions in which the diameter at the left shoulder is different from that at the right roll shoulder and a roll barrel portion formed by left and right surfaces that are different from each other in curvature. Applying this asymmetric roll for straightening to the straightening of a tube by a straightener makes it possible to avoid the collision of the leading end of the tube to be straightened against the roll, thereby suppressing the occurrence of leading-end deformation.

DESCRIPTION OF EMBODIMENTS

A method for straightening a tube of the present invention, which is premised on that a tube is straightened by using a straightener including a plurality of pairs of rolls in which concave type straightening rolls are oppositely disposed in a vertical direction with the axes of rotation thereof being crossed with each other, or a straightener including a single roll interposed between those plurality of pairs of rolls and located at only one of the upper and lower positions, is configured to use an asymmetric roll in which a diameter of the left roll shoulder as being a relative maximum diameter portion is different from that of the right roll shoulder as being the other relative maximum diameter portion, as the straightening roll for providing offsetting, in which a roll shoulder as being a relative maximum diameter portion having a smaller diameter is configured to be located on the tube entry side, while a roll shoulder as being the other relative maximum diameter portion having a larger diameter being located on the tube exit side.

Figure 1:
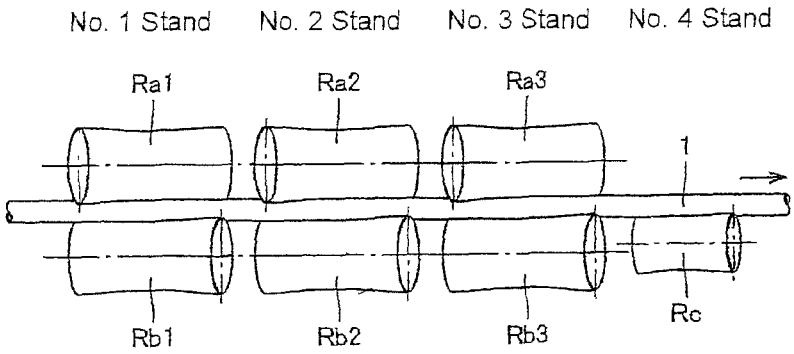
FIG. 1 PRIOR ART
FIG. 1 is a diagram showing an example of roll arrangement of a straightener.
Figure 2:
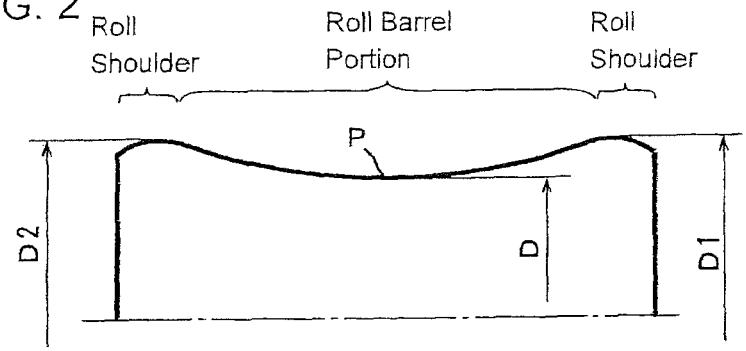
FIG. 2 PRIOR ART
FIG. 2 is a diagram to explain the configuration of straightening roll used in a straightener.
Figure 3:
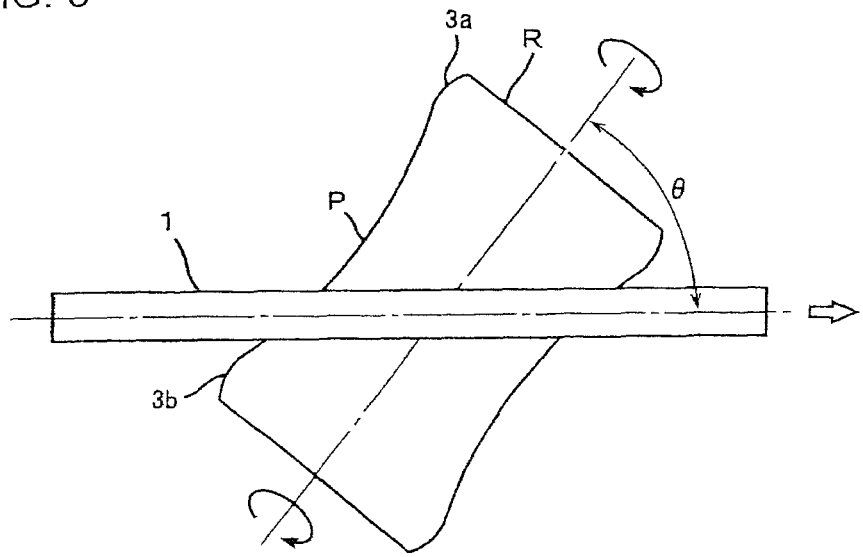
FIG. 3 is a diagram to explain a roll angle among setup conditions for roll straightening.
Figure 4:
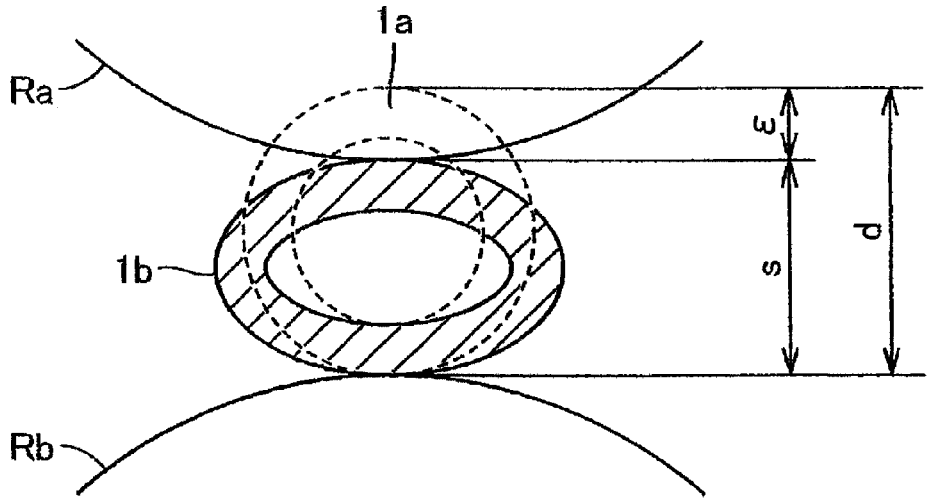
FIG. 4 is a diagram illustrating a crush amount among the setup conditions for roll straightening.

The above described "tube entry side" and "tube exit side" refer to the side on which a tube to be straightened is fed in a straightening roll, and the side on which the tube exits from the straightening roll, respectively. Since the straightening roll is disposed with inclination, the tube to be straightened will not pass through the middle portion (the vicinity of the groove bottom) of the roll, but it is fed into from a region deviated from the middle portion toward a first roll shoulder, and is to exit from a region deviated toward a second roll shoulder. Referring to above described FIG. 3, the region deviated from the middle portion of the roll (groove bottom P) toward the roll shoulder 3*b* is the tube entry side, and the region deviated toward the roll shoulder 3*a* is the tube exit side.

The reason why an asymmetric roll is used and is disposed such that a roll shoulder as being a relative maximum diameter portion having a smaller diameter is located on the tube entry side, while a roll shoulder as being the other relative maximum diameter portion having a larger diameter being located on the tube exit side is for the purpose of suppressing the occurrence of leading-end deformation when straightening a tube.

Figure 6:
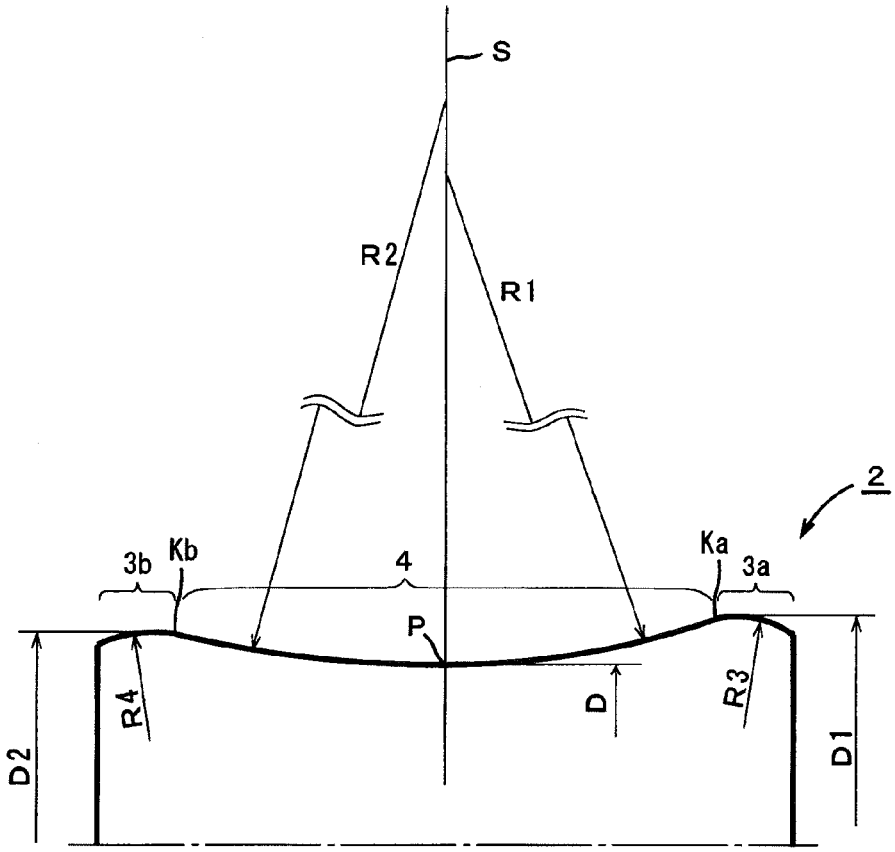
FIG. 6 is a diagram to explain the shape of an asymmetric roll for straightening of the present invention.
Figure 7:
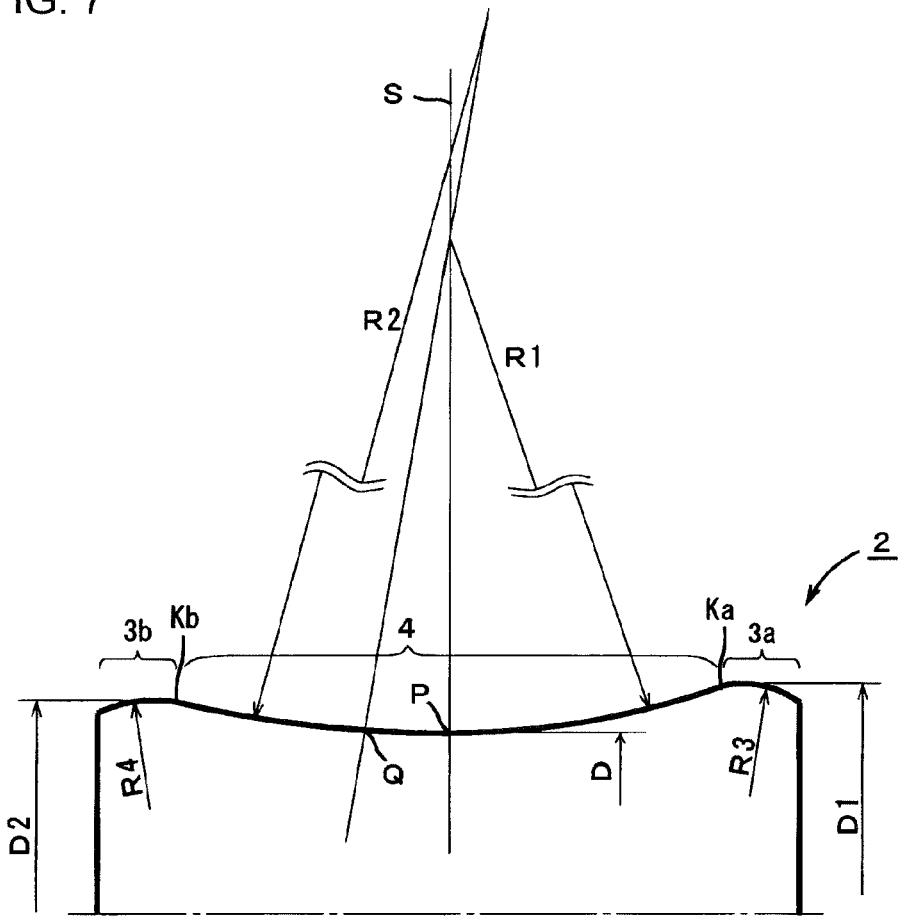
FIG. 7 is a diagram to explain another example of the shape of the asymmetric roll for straightening of the present invention.
Figure 8:
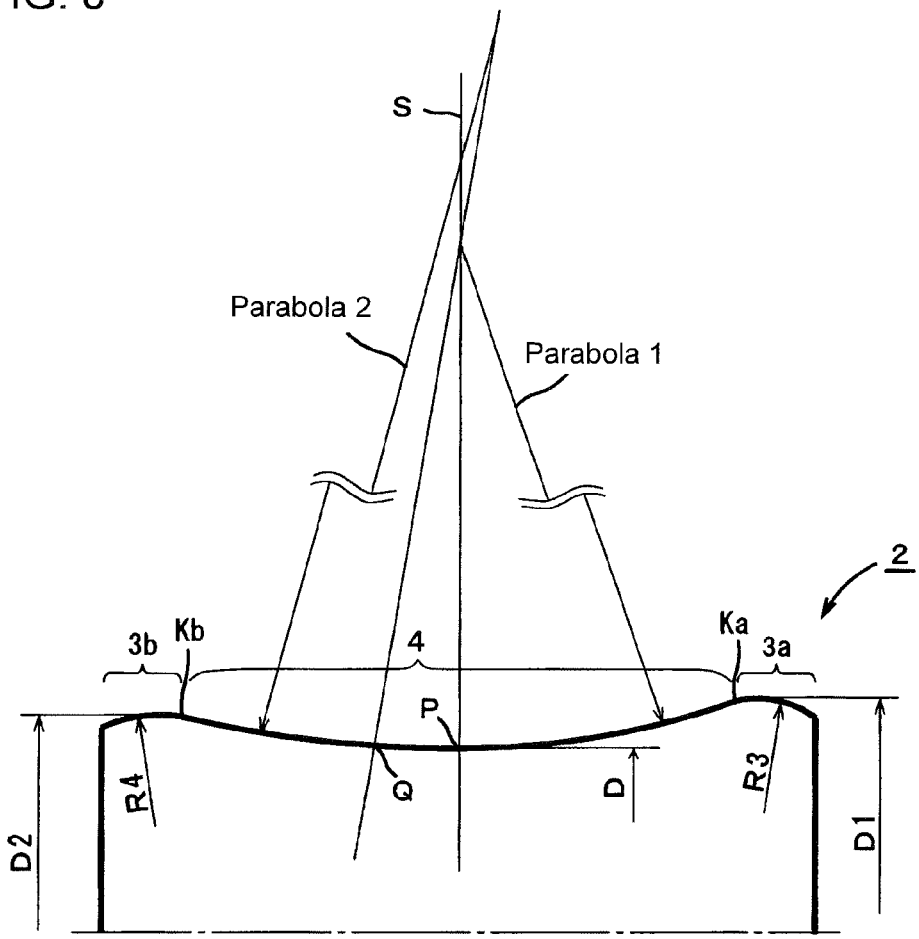
FIG. 8 is a diagram to explain yet another example of the shape of the asymmetric roll for straightening of the present invention.

FIGS. 6 to 8 are diagrams explaining the shape of an asymmetric roll to be used in a method for straightening a tube, which represent a roll section (only upper half above the central axis of roll) cut along any plane including the central axis of roll. It is noted that, in these figures, a straight line denoted by a reference symbol S represents a straight line that passes through a groove bottom P of a roll 2 and is normal to the roll central axis.

In an asymmetric roll 2 shown in FIGS. 6 to 8, the height (D1) of a roll shoulder 3*a* on the right-hand side on the sheet surface is not equal to the height (D2) of a roll shoulder 3*b* on the left-hand side, and it is noted that D1>D2 in each case meaning that the roll shape is left-right asymmetric. Reference symbols R3 and R4 denote the radii of curvatures of the curves (circular arcs) forming the roll shoulders 3*a* and 3*b*, respectively.

R1 shown in FIGS. 6 and 7 is the radius of curvature (circular arc) which reaches Ka (one end of the roll shoulder 3*a* on the right-hand side) from a connecting point Q (equivalent to the groove bottom P of the roll 2 in FIG. 6) out of the two curves (circular arcs in this case) representing a roll barrel portion 4; and R2 is the radius of curvature which reaches Kb (one end of the roll shoulder 3*b* on the left-hand side) from a connecting point Q (equivalent to the groove bottom P of the roll 2 in FIG. 6) out of the two curves (circular arcs) representing the roll barrel portion 4. It is noted that R1>R2 in any of FIGS. 6 and 7.

A parabola 1 shown in FIG. 8 means that the curve which reaches Ka (one end of the roll shoulder 3*a* on the right-hand side) from the connecting point Q out of the two curves representing a roll barrel portion 4 is a parabola, and a parabola 2 means that the curve which reaches Kb (one end of the roll shoulder 3*b* on the left hand side) from the connecting point Q out of the two curves representing the roll barrel portion 4 is a parabola.

That is, there is shown in FIG. 6, an example of shape in which each of two curves representing the barrel portion 4 of the roll 2 is formed of a single circular arc, whereas the left and right circular arc respectively have different radii of curvature with the groove bottom P being as a boundary, thus becoming asymmetric; and in FIG. 7, an example of shape in which each of two curves representing the barrel portion 4 of the roll 2 is formed of a single circular arc, whereas the left and right circular arcs respectively have different radii of curvature with the connecting point Q being as a boundary, thus becoming asymmetric. Further, there is shown in FIG. 8, an example of shape in which each of two curves representing the barrel portion 4 of the roll 2 is formed of a single circular parabola, whereas the left and right circular parabola respectively have different shapes with the connecting point Q being as a boundary, thus becoming asymmetric. The connecting point Q of the above described two curves may be located at any appropriate position on the right-hand side of the groove bottom P (between P and Ka). Moreover, the number of the curves representing the barrel portion 4 of the roll 2 is not limited to two, and the curve may have a shape in which three or more circular arcs or parabolas are linked.

Figure 5:
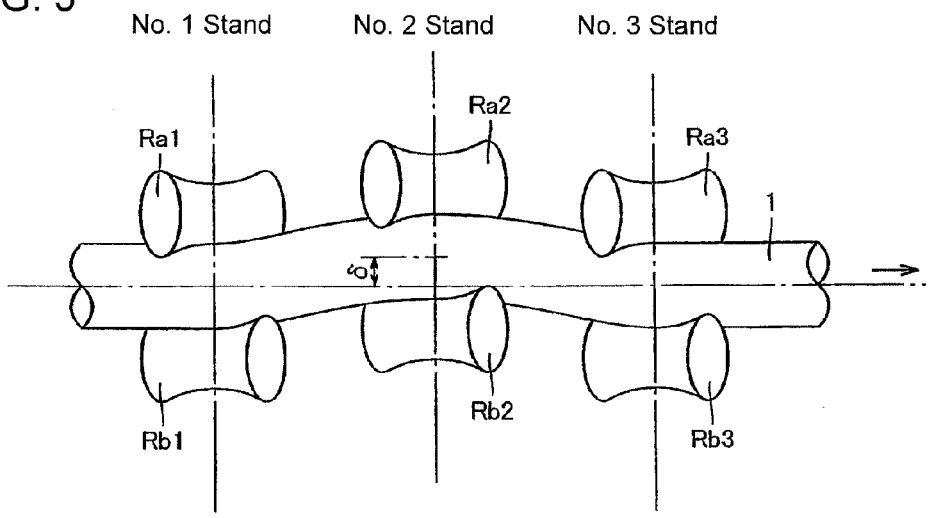
FIG. 5 is a diagram to explain an offset amount among the setup conditions for roll straightening.

When performing straightening by a straightener, for example, the height of axes of rotation for the straightening rolls Ra2 and Rb2 are raised to apply an offset amount δ (mm) to the tube 1 to be straightened as shown in above described FIG. 5. In this case, the front end of the tube 1 to be straightened points substantially in the horizontal direction immediately after it has passed through the straightening rolls Ra1 and Rb1. Therefore, if the offset amount is large, it becomes difficult to smoothly feed a tube into between the straightening rolls Ra2 and Rb2, and it is likely that the front end of the tube 1 to be straightened collides with the entry side of the lower roll Rb2, becoming subjected to impact. Moreover, since the straightening rolls Ra3 and Rb3 are inversely offset with respect to the straightening rolls Ra2 and Rb2, the front end of the tube 1 to be straightened which has passed through the straightening rolls Ra2 and Rb2 is more likely to collide with the entry side of the upper roll Ra3 when being fed into between the rolls Ra3 and Rb3.

Accordingly, an asymmetric roll is used as the straightening roll for giving offsetting with respect to the rolls of the stand located nearer to the entry side (the upstream side with respect to the traveling direction of the tube to be straightened) (the stand of earlier stage) to arrange such that the roll shoulder as being a relative maximum diameter portion having a smaller diameter is located on the tube entry side. In the case of the straightener shown in FIG. 5, asymmetric rolls are used for the straightening rolls Ra2 and Rb2 of No. 2 stand and the straightening rolls Ra3 and Rb3 of No. 3 stand to arrange such that the roll shoulder as being a relative maximum diameter portion having a smaller diameter is located in the tube entry side. This makes it possible to facilitate the feeding into between the straightening rolls Ra2 and Rb2 and the feeding into between the straightening rolls Rb3 and Rb3 thereby avoiding the leading end of the tube to be straightened from colliding against straightening rolls.

In this case, as described above, the position against which the leading end of the tube to be straightened is likely to collide is the entry side of the lower roll Rb2 in the case of No. 2 stand, and the entry side of the upper roll Ra3 in the case of No. 3 stand. Therefore, using asymmetric rolls at least for those rolls will make it possible to avoid the leading end of the tube to be straightened from colliding against straightening rolls. However, since using rolls in which upper and lower rolls have different shapes will make its control complicated, it is more preferable to use asymmetric rolls having the same shape for both the upper and lower rolls.

Further, regarding No. 1 stand which is located at the foremost entry side (upstream side) with respect to the traveling direction of a tube to be straightened, since the vertical position of a pair of rolls is adjusted such that the tube to be straightened is smoothly fed into (to be specific, the position of a pair of rolls in No. 1 stand is adjusted to a position at which the centerline of the tube to be straightened substantially coincides with the pass center of the distance between opposite upper and lower rolls), it is not likely that the front end of the tube to be straightened collides against the straightening rolls Therefore, it is not necessarily required to use an asymmetrical roll(s) for No. 1 stand. Of course, the use of an asymmetric roll will not be negated, and for example, when the collision of the front end portion of the tube to be straightened against the straightening rolls Ra1 and Rb1 may occur, the asymmetric rolls of the present invention may be used for the straightening rolls Ra1 and Rb1 of No. 1 stand as well.

Figure 9:
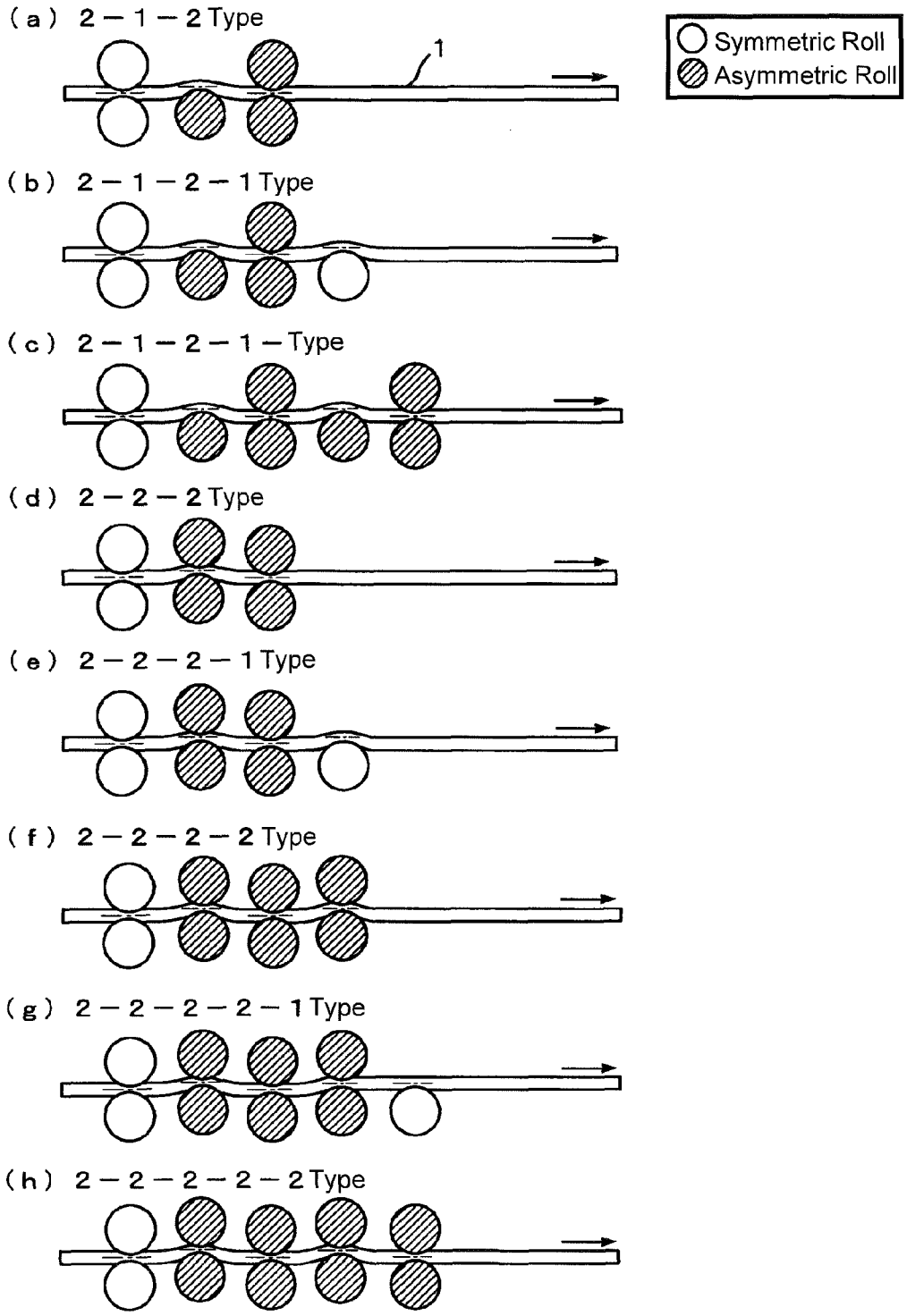
FIG. 9 is a diagram exemplifying various configurations of a straightener, and locations where an asymmetric roll is disposed in each straightener having the above described configurations of straightener.

FIG. 9 is a diagram exemplifying various configurations of straightener and locations where an asymmetric roll is applied in each straightener having the above described configurations of straightener. In FIG. 9, since only the number and disposition of straightening rolls and the locations where asymmetric rolls are applied are shown, the straightening rolls themselves are displayed in a simplified form without the roll angle being taken into consideration. The asymmetric rolls are indicated by hatched lines.

In FIG. 9, asymmetric rolls are applied to straightening rolls which are offset with respect to a pair of rolls (or a single roll) of the earlier stage. Asymmetric rolls may not be used for the straightening rolls of No. 1 stand as described above. The roll which is disposed only at the lower position of the last stand (see (b), (e) and (g) of FIG. 9) is an auxiliary roll for enhancing the straightening effect by adjusting it in a vertical direction. Regarding this auxiliary roll as well, an asymmetric roll may not be used since the collision of the front end of the tube to be straightened against the straightening roll can be suppressed by adjusting the roll angle (of course, where there is a risk of collision of the front end of the tube to be straightened against (the entry side of) an auxiliary roll due to conditions such as an offset amount, the asymmetric roll of the present invention can be used for the auxiliary roll as an effective countermeasure).

Moreover, although in FIG. 9, asymmetric rolls are provided to all the straightening rolls, except for straightening rolls of No. 1 stand and the auxiliary rolls, it is not necessarily required to provide asymmetric rolls for all the straightening rolls. For example, an asymmetric roll may not be used for straightening rolls for which a larger offset amount needs not to be applied (rolls of a stand for which only a smaller offset amount is given with respect to the rolls of preceding and succeeding stands).

Further, as described above, it is also possible to use an asymmetric roll only for either of upper and lower rolls of a pair of rolls oppositely disposed in a vertical direction. When a straightening roll is offset upwardly, the above described asymmetric roll is used for the lower roll of the relevant offset straightening roll, and when a straightening roll is offset downwardly, it is also possible to take on an embodiment in which the asymmetric roll is used for the upper roll of the relevant offset straightening roll. This is because, as described above, it is likely that the front end of a tube to be straightened collides against the lower roll of the relevant straightening roll when the axis of rotation of the straightening roll is offset upwardly, and collides against the upper roll of the relevant straightening roll when the axis of rotation of the straightening roll is offset downwardly. However, as described above, since using a pair of rolls in which upper and lower rolls have different shapes will make its control complicated, it is more preferable to use asymmetric rolls having the same shape for both the upper and lower rolls.

A 2-2-2-1 type straightener is often used for straightening tubes. In this case, it is preferable to use the above described asymmetric rolls for both the upper and lower rolls of pairs of straightening rolls in No. 2 stand and No. 3 stand.

The asymmetric roll for straightening of the present invention is applied to a roll which is to be offset with respect to the roll of the preceding stage, among straightening rolls for use in straighteners including concave type straightening rolls oppositely disposed in a vertical direction with the axes of rotation thereof being crossed with each other. As illustrated in FIGS. 6 to 8 described above, the relevant roll is a straightening roll comprising roll shoulders 3*a* and 3*b* which are formed at opposite ends, and a roll barrel portion 4 which lies between the roll shoulders and serves to press down a tube to be straightened, wherein, given that D1 is a maximum diameter of the roll shoulder as being a relative maximum diameter portion on the exit side of the tube to be straightened, D2 is a diameter of the roll shoulder as being the other relative maximum diameter portion on the entry side, and d is the outer diameter of the tube to be straightened, the following Formulae (i) and (ii) are satisfied:

$$D1 > D2 \quad \text{(i)}$$

$$0.004 \leq (D1 - D2)/d \leq 0.2 \quad \text{(ii)}$$

As shown in FIGS. 6 to 8, this asymmetric roll has a concave type shape, and comprises roll shoulders 3*a* and 3*b* as being relative maximum diameter portions which are formed at opposite ends and a roll barrel portion 4 having a surface which is curved toward the axial centerline of the roll starting from both the roll shoulders 3*a* and 3*b* (to be precise, end portions Ka and Kb of the shoulder portions 3*a* and 3*b*) to the length-wise middle of the roll (groove bottom P).

The above described roll shoulder 3*b* as being a relative maximum diameter portion has a diameter of D2 and is located on the tube entry side, while the roll shoulder 3*a* as being the other relative maximum diameter portion has a diameter of D1 and is located on the tube exit side. The reason why it is defined that D1>D2 (above described Formula (i)) in the straightening roll of the present invention is for the purpose of facilitating the feeding of the tube into the rolls by arranging such that the roll shoulder 3*b* as being a relative maximum diameter portion having a smaller diameter is located on the tube entry side, and the roll shoulder as being the other relative maximum diameter portion 3*a* having a larger diameter is located on the tube exit side, and thus avoiding the collision of the leading end of the tube to be straightened against the straightening rolls thereby suppressing the occurrence of leading-end deformation, when straightening a tube by using the asymmetric roll.

Further, in designing the straightening roll of the present invention, the roll diameters are defined to be in the range in which $0.004 \leq (D1 - D2)/d \leq 0.2$ (above described Formula (II)) is satisfied in consideration of the range of dimension defined by upper and lower limits (outer diameter d) of the subject material to be straightened by the relevant straightening machine. Here, the reason why the lower limit value is defined is that if (D1−D2)/d is less than 0.004, the effect on suppressing the leading-end deformation by the asymmetric roll shape of the present invention will become unable to be fully achieved. On the other hand, the reason why the upper limit value is defined is that if (D1−D2)/d is more than 0.2, the balance between the entry and exit sides of the roll becomes biased and thereby the straightening effect of bends by straightening declines. Using a roll within the range of Formula (II) will make it possible to prevent the leading-end deformation and to achieve a sufficient straightening effect of bends.

When using this asymmetric roll as the straightening roll when performing the method for straightening a tube of the present invention, arrangement is made, as described above, such that the roll shoulder 3*b* as being a relative maximum diameter portion having a smaller diameter is located on the entry side of the tube to be straightened, and the roll shoulder 3*a* as being the other relative maximum diameter portion having a larger diameter is located on the exit side of the tube to be straightened.

The straightening roll of the present invention can take on an embodiment in which the curve representing the outer surface of the roll shoulder portion in a section of the straightening roll cut along a plane including a roll central axis has a circular arc, and given that a radius of curvature of an entry-side roll shoulder in the section is CR2, and a radius of curvature of an exit-side roll shoulder is CR1, the following Formula (iii) is satisfied:

$$CR2/CR1>1.0 \quad \text{(iii)}$$

Figure 10:
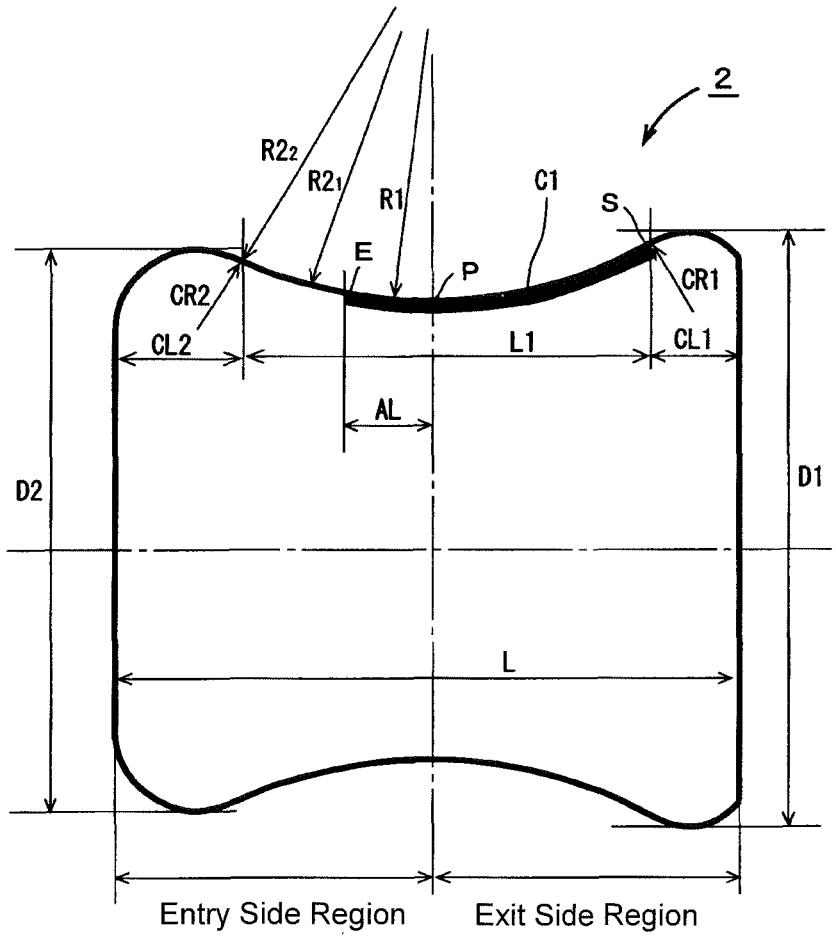
FIG. 10 is a diagram to explain the other example of the shape of the asymmetric roll of the present invention.

FIG. 10 is a diagram to explain the other example of the shape of the asymmetric roll of the present invention, which represents a section of roll cut along any plane including the roll central axis. The roll 2 comprises a barrel portion having an axial length of L1, an exit-side shoulder portion (having a length of CL1) and an entry-side shoulder portion (having a length of CL2), wherein a roll diameter D1 of an exit-side shoulder as being a relative maximum diameter portion and a roll diameter D2 of an entry-side shoulder as being the other relative maximum diameter portion are in the relationship of D1>D2. The embodiment described above is a straightening roll in which in addition to the definition of Formulae (i) and (ii) described above, the outer surfaces of opposite shoulder portions shown in the section of roll (the section including the roll central axis) is in a circular arc shape, and the size difference defined by Formula (iii) described above is provided for the radii of curvature: CR1 and CR2 so as to be asymmetric.

The reason why the outer surface of the roll shoulder portion is configured to be a circular arc shape is that it is a common practice to remove edges of corner portions, and the extent of roundness thereof can be easily adjusted by changing the radius of curvature. The reason why it is arranged to satisfy Formula (iii) is to facilitate the feeding of a tube to be straightened into the roll by configuring that the radius of curvature CR2 of the entry-side shoulder portion is larger than the radius of curvature CR1 of the exit-side shoulder portion so that the entry-side shoulder portion is in a milder sloping manner. Although the upper limit of Formula (iii) will not be specifically defined, since if the radius of curvature CR2 becomes excessively large, the roundness of the entry-side shoulder portion will be lost thereby impairing smooth feeding of the tube to be straightened into the roll, or the length of the entry-side shoulder portion needs to be increased (that is, the length of the barrel portion is relatively decreased) thereby causing a risk of declining the straightening effect, it is generally preferable to arrange such that CR2/CR1<2.0.

In the straightening roll (including embodiments which are added with the definition of above described Formula (iii)) of the present invention, further, a curve representing an outer surface of a roll barrel portion may consist of a plurality of circular arcs or approximated circular arcs in the curve representing the outer surface of roll in a section of the straightening roll cut along a plane including a roll central axis, wherein supposing a radius of curvature of a circular arc C1 passing through the groove bottom portion of roll on the outer surface thereof to be R1, among a plurality of circular arcs or approximated circular arcs, a radius or radii of curvature of one or more circular arcs or approximated circular arcs disposed toward entry side with respect to the circular arc C1 to be collectively $R2_i$, a distance between a cross section at the groove bottom portion of roll and an entry-side terminal end of the circular arc C1 to be AL, and an outer diameter of the tube to be straightened to be d, the following Formulae (iv) and (v) are satisfied:

$$R2_i/R1>1.0 \quad \text{(iv)}$$

$$0\leq AL/d\leq 1.5 \quad \text{(v)}$$

Where, the cross section at groove bottom portion of roll refers to a section which passes through a groove bottom portion of roll at which the roll diameter becomes minimum and is perpendicular to the roll central axis. Moreover, the subscript "i" of $R2_i$ indicates the number of relevant circular arcs or approximated circular arcs.

Here, "approximated circular arc" refers to each circular arc when a curve constituting an outer surface of roll barrel portion is represented by a plurality of circular arcs mathematically approximated by, for example, the least square method.

In the example shown in FIG. 10, while the curve representing the outer surface of the roll barrel portion (length L1) comprises a circular arc C1 (indicated by a bold curve in FIG. 10) having a radius of curvature of R1, and two circular arcs each having a radius of curvature of $R2_1$ or $R2_2$, while this is not limiting. Although the circular arc C1 passing the groove bottom portion of roll on the outer surface of roll is defined to have a radius of curvature of R1, part of the curve from the entry-side terminal end E of the circular arc C1 to the connecting point with the entry-side shoulder portion may include one or more circular arcs or approximated circular arcs. Moreover, while an exit-side starting end S of the circular arc C1 is a connecting point with an exit-side shoulder portion in the example shown in FIG. 10, one or more circular arcs or approximated circular arcs may be included as the curve constituting the outer surface of the roll barrel portion between the exit-side starting end of the circular arc C1 and the exit-side shoulder portion. As shown in the figure, the distance between a cross section at the groove bottom portion of roll and an entry-side terminal end of the circular arc C1 is AL.

The reason why in this embodiment, arrangement is made to satisfy Formula (iv) is because it is made possible to make the connection from the barrel portion to the entry-side shoulder portion reasonably smooth in the outer surface of roll. The roll diameter D2 of the entry-side shoulder portion as being a relative maximum diameter portion is smaller than the roll diameter D1 of the exit-side shoulder portion as being the other relative maximum diameter portion, and to make a link to the entry-side shoulder portion by smoothly connecting a plurality of circular arcs or approximated circular arcs from the entry-side terminal end of the circular arc C1 to the entry-side shoulder portion having a smaller diameter, it is necessary to make the radius of curvature larger as approaching to the entry-side shoulder portion as defined in Formula (iv), thereby forming a gentle shape. That is, it is preferable that $R2_{i+1}/R2_i \geq 1.0$ (the larger the subscript number "i", the nearer the circular arc is located relative to the entry side). Although the upper limit of $R2_i/R1$ is not specifically defined, it is naturally determined under a condition that the entry-side terminal end of the circular arc C1 and the entry-side shoulder portion are connected in a reasonably smooth manner.

Further, the reason why it is arranged to satisfy Formula (v) is for the purpose of securing an effect on suppressing the leading-end deformation, as well as decreasing the bias in the balance between the entry and exit sides, thereby securing straightening effect. If AL/d is more than 1.5, the entry-side terminal end of the circular arc C1 becomes too close to the entry-side shoulder portion so that the diameter of the entry-side roll shoulder as being a relative maximum diameter portion becomes too large, (D1−D2)/d decreases, and it becomes harder to achieve the effect of suppressing the leading-end deformation. On the other hand, when AL/d is small and below 0, since the balance in the roll entry and exit sides becomes biased, the effect of straightening bends by straightening declines.

Applying this embodiment makes it possible to arrange that the outer surface of the roll barrel portion comprises curves having various shapes without being limited to a single circular arc in a section cut along a plane including the roll central axis, and to finely adjust the curved surface constituting the roll barrel portion. This makes it possible to enhance straightening effect while suppressing the occurrence of leading-end deformation of a tube end portion.

EXAMPLES

Example 1

Straightening of a tube was performed with a carbon steel tube (material corresponding to API standard: X52) having an outer diameter of 34.0 mm and a wall thickness of 2.3 mm as a workpiece by applying the straightening method of the present invention to investigate the effect of suppressing the leading-end deformation of a tube end portion. It is noted that for comparison purpose, similar investigation was conducted for the case where an ordinary symmetric roll was used.

The straightener used was a 2-2-2-1 type straightener. Table 1 shows roll conditions. The roll condition 1 in Table 1 shows a case where symmetric rolls were used for all stands, and the roll condition 2 shows a case where an asymmetric roll was used for upper and lower rolls of No. 2 stand and No. 3 stand.

TABLE 1

| | | No. 1 Stand | No. 2 Stand | No. 3 Stand | No. 4 Stand |
|---|---|---|---|---|---|
| Roll condition 1 | Upper roll | Symmetric roll | Symmetric roll | Symmetric roll | — |
| | Lower roll | Symmetric roll | Symmetric roll | Symmetric roll | Symmetric roll |
| Roll condition 2 | Upper roll | Symmetric roll | Asymmetric roll | Asymmetric roll | — |
| | Lower roll | Symmetric roll | Asymmetric roll | Asymmetric roll | Symmetric roll |

The dimensions of each portion of asymmetric rolls are shown in Table 2. The difference in height (D1−D2) between the tube-entry-side roll shoulder 3*b* and the exit-side roll shoulder 3*a* was 3.2 mm. Moreover, as a comparative example, a case where the value of (D1−D2)/d deviated from the range defined in the straightening roll of the present invention is also shown. The length of the roll barrel portion was 170 mm and the widths of the left and right roll shoulders were 12 mm, respectively.

TABLE 2

| | Dimensions of each part of asymmetric roll (unit: mm) | | Value of (D1 − D2)/d | Test results |
|---|---|---|---|---|
| Comparative Example of claim 4 | D (Roll diameter at middle groove bottom) | 95.0 | 0.0029 | Leading-end deformation occurred |
| | D1 (Exit-side shoulder diameter) | 122.6 | | |
| | D2 (Entry-side shoulder diameter) | 122.5 | | |
| Example | D (Roll diameter at middle groove bottom) | 95.0 | 0.0941 | Good |
| | D1 (Exit-side shoulder diameter) | 122.6 | | |
| | D2 (Entry-side shoulder diameter) | 119.4 | | |
| Comparative Example of claim 4 | D (Roll diameter at middle groove bottom) | 95.0 | 0.235 | Bends remained |
| | D1 (Exit-side shoulder diameter) | 122.6 | | |
| | D2 (Entry-side shoulder diameter) | 114.6 | | |

[Remarks] Length of roll barrel portion: 170 mm
Width of roll shoulder: 12 mm for left and right
Outer diameter of tube to be straightened: 34 mm Table 3 shows straightening conditions (crush amount and offset amount). "Opened until passage of tube" in No. 1 stand means that a crush was not applied until the leading end portion of the tube to be straightened passed through the rolls of No. 1 stand, and a crush amount of 0.8 mm was applied after the leading end portion passed through the rolls. In the present embodiment, these conditions were chosen to confirm the state of the occurrence of the leading-end deformation which was caused by the collision of the tube to be straightened against the rolls of No. 2 stand and No. 3 stand, which were offset above and below with respect to the pass-line at the stand of previous stage, respectively. That is, for the purpose of inhibiting the occurrence of the leading-end deformation at No. 1 stand from the investigation results, No. 1 stand was kept to be "opened until passage of tube".

TABLE 3

(Unit: mm)

| | No. 1 Stand | No. 2 Stand | No. 3 Stand | No. 4 Stand |
|---|---|---|---|---|
| Crush | Opened until passage of tube | 0.8 | 0.8 | |
| Offset | | 1.23 | | 1.23 |

Figure 11:
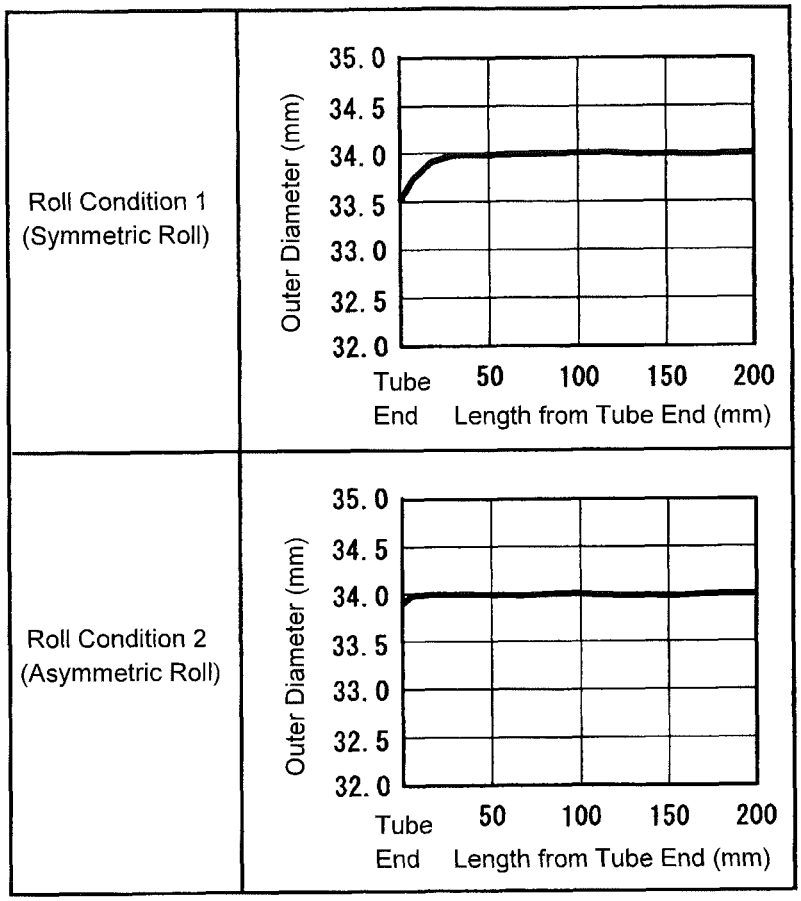
FIG. 11 is a diagram showing the relationship between the length from a tube end and the outer diameter of the tube, showing the result of investigation on the effect of application of an asymmetric roll on the leading-end deformation.

FIG. 11 shows the investigation results of the leading-end deformation of a tube end portion. FIG. 11 is a diagram showing the relationship between the length from tube end and the tube outer diameter, which was determined by measuring respective outer diameters corresponding to each length from the tube end. The measurement of outer diameter at each length was respectively performed at two locations (a reference position (0°) and a position 90° away from the reference position) in the circumference of the tube and the outer diameters are displayed in their average values.

As shown in FIG. 11, in roll condition 1 in which symmetric rolls were used, the leading-end deformation occurred so that part of the tube end portion was bent toward the central axis of tube, and the outer diameter of tube decreased so that the deformation extended about 30 mm from the tube end.

In contrast, in roll condition 2 in which asymmetric rolls were applied, the leading-end deformation at the tube end portion was remarkably improved, and there was substantially no damage on the outer diameter.

used, which was an Inventive Example, was different from the setup condition for the case where a symmetric roll was used, which was a Comparative Example. In other words, when the asymmetric rolls were used, it was possible to set a high offset amount (5 to 6.6 mm) for the offset of No. 2 stand without causing the leading-end deformation of a tube end portion.

TABLE 4

(Unit: mm)

| | | No. 1 Stand | No. 2 Stand | No. 3 Stand | No. 4 Stand | Number of tubes with bends (pieces) | Number of tubes processed (pieces) | Rate of bend defective (%) |
|---|---|---|---|---|---|---|---|---|
| Comparative Example (symmetric roll) | Crush | 0.5 | 3.0 | 2.0 | | 13 | 1,126 | 1.15 |
| | Offset | | 2.0 | | 1.0 | | | |
| Inventive Example 2 (asymmetric roll) | Crush | 0.5 | 0 | 0.5 | | 0 | 753 | 0 |
| | Offset | | 6.6 | | 1.0 | | | |
| Inventive Example 3 (asymmetric roll) | Crush | 0.5 | 5 | 5 | | 5 | 1,282 | 0.39 |
| | Offset | | 5 | | 2 | | | |
| Inventive Example 4 (asymmetric roll) | Crush | 0.5 | 3 | 3 | | 10 | 3,410 | 0.29 |
| | Offset | | 5 | | 0 | | | |

From above described investigation results, it was found that applying asymmetric rolls to the straightening rolls enables the prevention of leading-end deformation of a tube end portion.

Example 2 to Example 4

In commercial operations, carbon steel tubes (material corresponding to API standard: L80-1) each having an outer diameter of 139.7 mm and a wall thickness of 7.72 mm were straightened by applying the straightening method of the present invention to investigate the straightening rate of tested tubes in which bends had not been sufficiently straightened out and bends remained even after the straightening (rate of bend defective). When performing straightening, taking into consideration of the investigation results obtained in Example 1, test was conducted in advance to set straightening conditions (see Table 4) where leading-end deformation of a tube end portion would not occur. Moreover, for the purpose of comparison, investigation results of the rate of bend defective in an operation (commercial operation) before the present invention was applied, that is, investigation results in the case where symmetric rolls were used to perform straightening are listed as well.

Table 4 shows setup conditions (crush amount and offset amount) in the cases where an asymmetric roll was used and a symmetric roll was used. In Table 4 and Table 5 to be shown later, Inventive Example 2 corresponds to the case where the asymmetric roll shown in above described FIG. 6 was applied, Inventive Example 3 the case where the asymmetric roll shown in above described FIG. 7 was applied, and Inventive Example 4 to the case where the asymmetric roll shown in above described FIG. 8 was applied, respectively.

Each of these cases was investigated in commercial operation, and since the tube to be straightened was not a test material but a product, the setup conditions were chosen so that the leading-end deformation would not occur. Therefore, the setup condition for the case where an asymmetric roll was A 2-2-2-1 type straightener was used and the asymmetric rolls shown in FIGS. 6 to 8 and Table 5 were applied to the upper and lower rolls of No. 2 stand and No. 3 stand. The difference (D1−D2) in the height between the tube-entry-side roll shoulder 3*b* and the exit-side roll shoulder 3*a* was 8 mm in Inventive Example 2, 4 mm in Inventive Example 3, and 4.5 mm in Inventive Example 4. Moreover, the length of the roll barrel portion and the width of the roll shoulder portion were the same in any of Inventive Examples 2 to 4 so that the length of roll barrel portion was 440 mm, and the width was 80 mm for the left and right roll shoulder portions, respectively.

TABLE 5

| | Dimensions of each part of asymmetric roll (unit: mm) | | Value of (D1 − D2)/d |
|---|---|---|---|
| Comparative Example (symmetric roll) | D (Roll diameter at middle groove bottom) | 420.0 | 0 |
| | D1 (Exit-side shoulder diameter) | 482.2 | |
| | D2 (Entry-side shoulder diameter) | 482.2 | |
| Inventive Example 2 (asymmetric roll) | D (Roll diameter at middle groove bottom) | 420.0 | 0.057 |
| | D1 (Exit-side shoulder diameter) | 482.2 | |
| | D2 (Entry-side shoulder diameter) | 474.2 | |
| Inventive Example 3 (asymmetric roll) | D (Roll diameter at middle groove bottom) | 420.0 | 0.029 |
| | D1 (Exit-side shoulder diameter) | 482.2 | |
| | D2 (Entry-side shoulder diameter) | 478.2 | |
| Inventive Example 4 (asymmetric roll) | D (Roll diameter at middle groove bottom) | 420.0 | 0.032 |
| | D1 (Exit-side shoulder diameter) | 472.5 | |
| | D2 (Entry-side shoulder diameter) | 468.0 | |

TABLE 5-continued

| | Dimensions of each part of asymmetric roll (unit: mm) | Value of (D1 − D2)/d |
|---|---|---|

[Remarks] Length of roll barrel portion: 440 mm
Width of roll shoulder: 80 mm for each of left-hand side and right-hand side portion
Outer diameter of tube to be straightened: 139.7 mm The investigation results of the rate of bend defective are shown collectively in Table 4. The acceptance standard for bend defective was 2/1000 (mm), and when a bend not smaller than 2 mm was recognized for a length of 1 m of the tube after straightening, it was judged to be a bend defective. While the rate of bend defective was 1.15% when the symmetric roll was used, when asymmetric rolls of the present invention were used; in Inventive Example 2, there was no tube in which bends were recognized after straightening, meaning a rate of bend defective of 0%; 0.39% in Inventive Example 3, and 0.29% in Inventive Example 4. In all of these Inventive Examples, the rate of bend defective was significantly reduced compared with the case where the symmetric roll was used.

This is because applying the asymmetric rolls of the present invention made it possible to give a large offset to a tube without causing the leading-end deformation of a tube end portion.

Table 6 shows the results of investigation of the rate of bend defective for a long period of time conducted in commercial operation by applying the straightening method of the present invention. While the majority of investigated tubes was a carbon steel tube, tubes made of alloy steel were also included. The straightener used for straightening was 2-2-2-1 type, and asymmetric rolls were applied to the upper and lower rolls of No. 2 stand and No. 3 stand. In Table 6, Inventive Example 2 corresponds to the case where the asymmetric roll shown in above described FIG. 6 was applied, Inventive Example 3 the case where the asymmetric roll shown in above described FIG. 7 was applied, and Inventive Example 4 to the case where the asymmetric roll shown in above described FIG. 8 was applied, respectively.

TABLE 6

| | Number of tubes with bends (pieces) | Number of tubes processed (pieces) | Rate of bend defective (%) | Evaluation |
|---|---|---|---|---|
| Comparative Example (symmetric roll) | 7,114 | 322,182 | 2.21 | |
| Inventive Example 2 (asymmetric roll) | 316 | 28,169 | 1.12 | ○ (Good) |
| Inventive Example 3 (asymmetric roll) | 623 | 39,799 | 1.57 | ○ (Good) |
| Invenbtive Example 4 (asymmetric roll) | 510 | 39,682 | 1.29 | ○ (Good) |

As shown in Table 6, it is seen that when the asymmetric rolls were applied, the rate of bend defective was significantly reduced compared with the case where the symmetric roll was used.

Example 5

Straightening of a tube was performed with a carbon steel tube (material corresponding to API standard: L80-1) having an outer diameter of 139.7 mm, a wall thickness of 7.72 mm, and a length of 6000 mm as the workpiece by applying the straightening roll of the present invention to investigate the effect on suppressing the leading-end deformation of a tube end portion after straightening. Furthermore, for comparison purpose, similar investigation was conducted for the case where an ordinary symmetric roll was used. The number of steel tubes subjected to the test was 350.

The straightener used was a 2-2-2-1 type straightener. Table 7 shows roll conditions and straightening setup conditions (crush amount and offset amount). Inventive Example in Table 7 is the case where an asymmetric roll (CR2/CR1=1.05 to 1.15, (D1−D2)/d=0.02 to 0.1) was applied to the upper and lower rolls of No. 1 to No. 3 stands. The Comparative Example is the case where a symmetric roll (CR2/CR1=1.00, (D1−D2)/d=0) was applied for each of upper and lower rolls in No. 1 to No. 3 stands.

TABLE 7

| | | Roll | CR2/CR1 | (D1 − D2)/d | Crush (mm) | Offset (mm) | Leading-end deformation length (mm) |
|---|---|---|---|---|---|---|---|
| Inventive Example | No. 1 Stand | Upper roll | 1.05 | 0.020 | 0.5 | 0 | 2.5-4 |
| | | Lower roll | 1.05 | 0.020 | | | |
| | No. 2 Stand | Upper roll | 1.15 | 0.100 | 3.0 | 4-7 | |
| | | Lower roll | 1.15 | 0.100 | | | |
| | No. 3 Stand | Upper roll | 1.11 | 0.057 | 1.5 | 0 | |
| | | Lower roll | 1.11 | 0.057 | | | |
| Comparative Example | No. 1 Stand | Upper roll | 1.00 | 0 | 0.5 | 0 | 11-15 |
| | | Lower roll | 1.00 | 0 | | | |
| | No. 2 Stand | Upper roll | 1.00 | 0 | 2.5 | 4-7 | |
| | | Lower roll | 1.00 | 0 | | | |
| | No. 3 Stand | Upper roll | 1.00 | 0 | 1.5 | 0 | |
| | | Lower roll | 1.00 | 0 | | | |

Investigation results are collectively shown in Table 7. The leading-end deformation of a tube end portion after straightening occurred as the result of the leading end of the tube striking the entry-side roll shoulder of No. 2 stand or the stand thereafter. The leading end of the tube was deformed into an oval shape, and the length of the deformed portion increased as the offset amount increased. As the leading-end deformation length increases, the amount of the tube to be cut-off increases for that part, and the yield thereof declines. As it is obvious from Table 7, Inventive Example exhibited a profound effect in that the leading-end deformation length of a tube end portion was one-fourth of that of Comparative Example.

Example 6

Straightening of a tube was performed with a carbon steel tube (material corresponding to API standard: L80-1) having an outer diameter of 73 to 140 mm as the workpiece by applying the straightening roll of the present invention to investigate the effect of suppressing the leading-end deformation of a tube end portion after straightening and the rate of bend defective after straightening. Furthermore, for comparison purpose, similar investigation was conducted for the case where an ordinary symmetric roll was used. The number of steel tubes subjected to the test was 350.

The straightener used was a 2-2-2-1 type straightener. Table 8 shows roll conditions and straightening setup conditions (crush amount and offset amount). In Table 8, Inventive Example was the case where an asymmetric roll (both of $R2_1$/R1 and $R2_2$/R1 were 1.05 to 1.30, and (D1−D2)/d=0.020 to 0.100) was applied for each of upper and lower rolls in No. 1 to No. 3 stands; and Comparative Example was the case where a symmetric roll (both $R2_1$/R1 and $R2_2$/R1 were 1.00, and (D1−D2)/d=0) was applied for each of upper and lower rolls in No. 1 to No. 3 stands.

TABLE 8

| | | | Roll | $R2_1/R1$ | $R2_2/R1$ | (D1 − D2)/d | AL/d | Crush (mm) | Offset (mm) | Leading-end deformation length (mm) | Rate of bend defective (%) | Evaluation |
|---|---|---|---|---|---|---|---|---|---|---|---|---|
| Inventive Example | Case 1 | No. 1 stand | Upper roll | 1.05 | 1.05 | 0.020 | 0.0 | 0.5 | 0 | 3.1-5 | 1.10 | ○ |
| | | | Lower roll | 1.05 | 1.05 | 0.020 | 0.0 | | | | | |
| | | No. 2 stand | Upper roll | 1.30 | 1.30 | 0.100 | 0.0 | 1.4 | 3 | | | |
| | | | Lower roll | 1.30 | 1.30 | 0.100 | 0.0 | | | | | |
| | | No. 3 stand | Upper roll | 1.15 | 1.15 | 0.057 | 0.0 | 1.2 | 0 | | | |
| | | | Lower roll | 1.15 | 1.15 | 0.057 | 0.0 | | | | | |
| | Case 2 | No. 1 stand | Upper roll | 1.05 | 1.05 | 0.020 | 0.7 | 0.5 | 0 | 4.5-8 | 0.80 | ○ |
| | | | Lower roll | 1.05 | 1.05 | 0.020 | 0.7 | | | | | |
| | | No. 2 stand | Upper roll | 1.30 | 1.30 | 0.100 | 0.7 | 2.2 | 3-6 | | | |
| | | | Lower roll | 1.30 | 1.30 | 0.100 | 0.7 | | | | | |
| | | No. 3 stand | Upper roll | 1.15 | 1.15 | 0.057 | 0.7 | 1.5 | 0 | | | |
| | | | Lower roll | 1.15 | 1.15 | 0.057 | 0.7 | | | | | |
| | Case 3 | No. 1 stand | Upper roll | 1.05 | 1.05 | 0.020 | 0.5 | 0.5 | 0 | 6.0-9 | 0.90 | ○ |
| | | | Lower roll | 1.05 | 1.05 | 0.020 | 0.5 | | | | | |
| | | No. 2 stand | Upper roll | 1.30 | 1.30 | 0.100 | 0.5 | 3.0 | 4-7 | | | |
| | | | Lower roll | 1.30 | 1.30 | 0.100 | 0.5 | | | | | |
| | | No. 3 stand | Upper roll | 1.15 | 1.15 | 0.057 | 0.5 | 1.5 | 0 | | | |
| | | | Lower roll | 1.15 | 1.15 | 0.057 | 0.5 | | | | | |
| | | No. 2 stand | Upper roll | 1.00 | 1.00 | 0.000 | 0.5 | 3.0 | 4-7 | | | |
| | | | Lower roll | 1.00 | 1.00 | 0.000 | 0.5 | | | | | |
| | | No. 3 stand | Upper roll | 1.00 | 1.00 | 0.000 | 0.5 | 1.5 | 0 | | | |
| | | | Lower roll | 1.00 | 1.00 | 0.000 | 0.5 | | | | | |
| Comparative Example | Case 4 | No. 1 stand | Upper roll | 1.00 | 1.00 | 0.000 | 0.0 | 0.5 | 0 | 6.5-9 | 1.20 | X |
| | | | Lower roll | 1.00 | 1.00 | 0.000 | 0.0 | | | | | |
| | | No. 2 stand | Upper roll | 1.00 | 1.00 | 0.000 | 1.5 | 1.4 | 3-6 | | | |
| | | | Lower roll | 1.00 | 1.00 | 0.000 | 1.5 | | | | | |
| | | No. 3 stand | Upper roll | 1.00 | 1.00 | 0.000 | 1.1 | 1.5 | 0 | | | |
| | | | Lower roll | 1.00 | 1.00 | 0.000 | 1.1 | | | | | |
| | Case 5 | No. 1 stand | Upper roll | 1.00 | 1.00 | 0.000 | 0.7 | 0.5 | 0 | 8.2-12 | 1.80 | X |
| | | | Lower roll | 1.00 | 1.00 | 0.000 | 0.7 | | | | | |
| | | No. 2 stand | Upper roll | 1.00 | 1.00 | 0.000 | 0.7 | 2.2 | 3-6 | | | |
| | | | Lower roll | 1.00 | 1.00 | 0.000 | 0.7 | | | | | |
| | | No. 3 stand | Upper roll | 1.00 | 1.00 | 0.000 | 0.7 | 1.5 | 0 | | | |
| | | | Lower roll | 1.00 | 1.00 | 0.000 | 0.7 | | | | | |
| | Case 6 | No. 1 stand | Upper roll | 1.00 | 1.00 | 0.000 | 0.5 | 0.5 | 0 | 10-15 | 2.20 | X |
| | | | Lower roll | 1.00 | 1.00 | 0.000 | 0.5 | | | | | |
| | | No. 2 stand | Upper roll | 1.00 | 1.00 | 0.000 | 0.5 | 3.0 | 4-7 | | | |
| | | | Lower roll | 1.00 | 1.00 | 0.000 | 0.5 | | | | | |
| | | No. 3 stand | Upper roll | 1.00 | 1.00 | 0.000 | 0.5 | 1.5 | 0 | | | |
| | | | Lower roll | 1.00 | 1.00 | 0.000 | 0.5 | | | | | |

Test results are summarized and collectively shown in Table 8. In Table 8, a symbol ○ in the column of "Evaluation" indicates a case where the leading-end deformation length was less than 10 mm, and the rate of defective in the straightening-out of bends is less than 1.2%, and a symbol × indicates a case where either one or both conditions applied: the leading-end deformation length was not less than 10 mm and the rate of defective in the straightening-out of bends was not less than 1.2%.

As shown in Table 8, it was confirmed that applying the present invention enables to reduce the leading-end deformation of a tube end portion after straightening to not more than 10 mm, and to improve the rate of defective in the straightening of bends.

INDUSTRIAL APPLICABILITY

The method for straightening a tube of the present invention and the straightening roll of the present invention can be effectively utilized in the production of tubes such as steel tubes.

| REFERENCE SIGNS LIST | |
|---|---|
| 1, 1a, 1b: | Tube to be straightened |
| 2: | Asymmetric roll |

-continued

| REFERENCE SIGNS LIST | |
|---|---|
| 3a, 3b: | Roll shoulder portion |
| 4: | Roll barrel portion |

What is claimed is:

1. A method for straightening a tube by using a straightener in which three or more pairs of rolls, each pair being formed of two rolls oppositely disposed in a vertical direction, are back-to-back disposed along a traveling direction of a tube to be straightened, wherein a concave shape asymmetric roll, in which a roll diameter of a left roll shoulder as being a relative maximum diameter portion is different from that of a right roll shoulder as being the other relative maximum diameter portion, is used for both upper and lower rolls provided in at least one pair of rolls, except for a pair of rolls located at foremost entry side with respect to the traveling direction of the tube to be straightened among the plural pairs of rolls, and each asymmetric roll is arranged such that the roll shoulder as being a relative maximum diameter portion having a smaller diameter is configured to be located on a tube entry side, while the roll shoulder as being the other relative maximum diameter portion having a larger diameter being located on a tube exit side, where the roll diameter of the shoulder portion of the asymmetric roll refers to a roll diameter of the relevant shoulder portion when the relevant roll is disposed such that the roll central axis is horizontal, and is observed from a direction normal to said axis.

2. The method for straightening a tube according to claim 1, wherein used is a 2-2-2-1 type straightener in which three pairs of rolls are back-to-back disposed from the entry side along the traveling direction of the tube to be straightened, and a single roll is disposed thereafter at either of upper and lower positions, and an asymmetric roll is used for each of upper and lower rolls in second and third pairs of rolls with respect to the entry side.

3. A method for straightening a tube by using a straightener in which plural pairs of rolls, each pair being formed of two rolls oppositely disposed in a vertical direction, are disposed with a single roll being interposed between the plural pairs of rolls and being located at either of upper and lower positions, wherein a concave shape asymmetric roll, in which a roll diameter of a left roll shoulder as being a relative maximum diameter portion is different from that of a right roll shoulder as being the other relative maximum diameter portion, is used for both upper and lower rolls provided in at least one pair of rolls, except for a pair of rolls located at foremost entry side with respect to the traveling direction of the tube to be straightened among the plural pairs of rolls, and is used for the single roll interposed between the plural pairs of rolls and located at either of upper and lower positions, and each asymmetric roll is arranged such that the roll shoulder as being a relative maximum diameter portion having a smaller diameter is configured to be located on a tube entry side, while the roll shoulder as being the other relative maximum diameter portion having a larger diameter being located on a tube exit side, where the roll diameter of the shoulder portion of the asymmetric roll refers to a roll diameter of the relevant shoulder portion when the relevant roll is disposed such that the roll central axis is horizontal, and is observed from a direction normal to said axis.

* * * * *